US006241546B1

(12) United States Patent
Lee et al.

(10) Patent No.: US 6,241,546 B1
(45) Date of Patent: Jun. 5, 2001

(54) ELECTRONIC DEVICE HAVING A HOUSING ADAPTED FOR MOUNTING WITH DIFFERENTLY-SIZED NETWORK SOCKET CONNECTORS

(75) Inventors: Chung-Pi Lee; Yuan-An Hsu, both of Taipei (TW)

(73) Assignee: Compal Electronics, Inc., Taipei (TW)

( * ) Notice: Subject to any disclaimer, the term of this patent is extended or adjusted under 35 U.S.C. 154(b) by 0 days.

(21) Appl. No.: 09/464,386

(22) Filed: Dec. 16, 1999

(51) Int. Cl.[7] ..... H01R 4/50; H01R 13/625

(52) U.S. Cl. ..... 439/344

(58) Field of Search ..... 439/344, 135, 439/136, 540, 145, 296

(56) References Cited

U.S. PATENT DOCUMENTS 5,118,311 * 6/1992 Margini ..... 439/676

5,299,943 * 4/1994 Shieh ..... 439/136

* cited by examiner

*Primary Examiner*—Brian Sircus
*Assistant Examiner*—Javaid Nasri
(74) *Attorney, Agent, or Firm*—Pillsbury Winthrop LLP

(57) ABSTRACT

An electronic device includes a socket connector, a housing, a mounting frame, a socket retaining unit and a frame retaining unit. The socket connector has a front connector mating portion adapted for mating with a complementary electrical connector, and a rear circuit connecting portion. The housing has a side wall formed with a mounting hole which is larger than a cross-sectional size of the socket connector. The mounting frame is disposed around the socket connector, and extends through the mounting hole. The socket retaining unit is provided on the socket connector and the mounting frame, and retains the socket connector on the mounting frame. The frame retaining unit is provided on the mounting frame and the housing, and retains the mounting frame on the housing.

18 Claims, 9 Drawing Sheets

ELECTRONIC DEVICE HAVING A HOUSING ADAPTED FOR MOUNTING WITH DIFFERENTLY-SIZED NETWORK SOCKET CONNECTORS

BACKGROUND OF THE INVENTION

1. Field of the Invention

This invention relates to an electronic device, such as a computer, which has a housing adapted for mounting with differently-sized socket connectors while obviating the need for forming mounting holes of different sizes.

2. Description of the Related Art

An electronic device, such as a notebook computer, has a housing which is formed with a mounting hole for mounting a network socket connector. As there are various socket connectors which are commonly used and which have different sizes, differently-sized mounting holes have to be formed in the computer housing so as to be able to mount different socket connectors. FIG. 1 shows an IEEE 1394 socket connector 12, a local area network (LAN) socket connector 13 and a modem socket connector 14, which have different sizes. Conventionally, a computer housing 1 is formed with a mounting hole 11 suitable for mounting of only one of the socket connectors 12, 13, 14. Thus, the connector mounted on the computer housing 1 cannot be replaced with a different one for expanded use of the computer. In addition, the manufacture of computer housings 1 with differently-sized mounting holes 11 requires different molds that lead to an increased manufacturing cost.

SUMMARY OF THE INVENTION

Therefore, the object of the present invention is to provide an electronic device having a housing adapted for mounting with differently-sized network socket connectors while obviating the need for forming mounting holes of different sizes.

Accordingly, the electronic device of the present invention includes a socket connector, a housing, a mounting frame, a socket retaining unit, and a frame retaining unit. The socket connector has a front connector mating portion adapted for mating with a complementary electrical connector, and a rear circuit connecting portion. The housing has a side wall formed with a mounting hole which is larger than a cross-sectional size of the socket connector. The mounting frame is disposed around the socket connector, and extends through the mounting hole. The socket retaining unit is provided on the socket connector and the mounting frame, and retains the socket connector on the mounting frame. The frame retaining unit is provided on the mounting frame and the housing, and retains the mounting frame on the housing.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
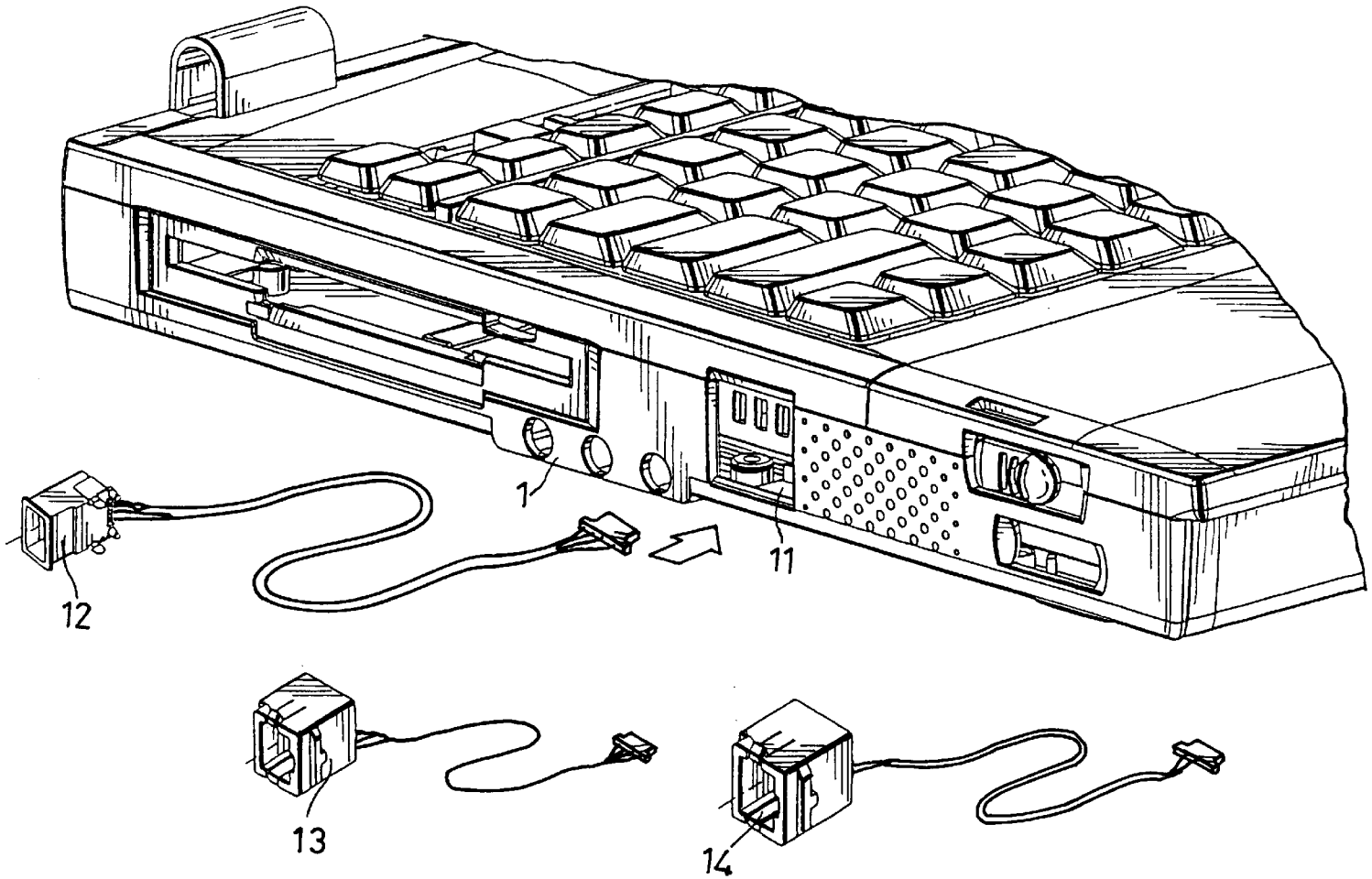
FIG.1 PRIOR ART
FIG. 1 is a fragmentary perspective view illustrating three kinds of conventional network socket connectors and a computer housing for mounting with one of the socket connectors.
Figure 2:
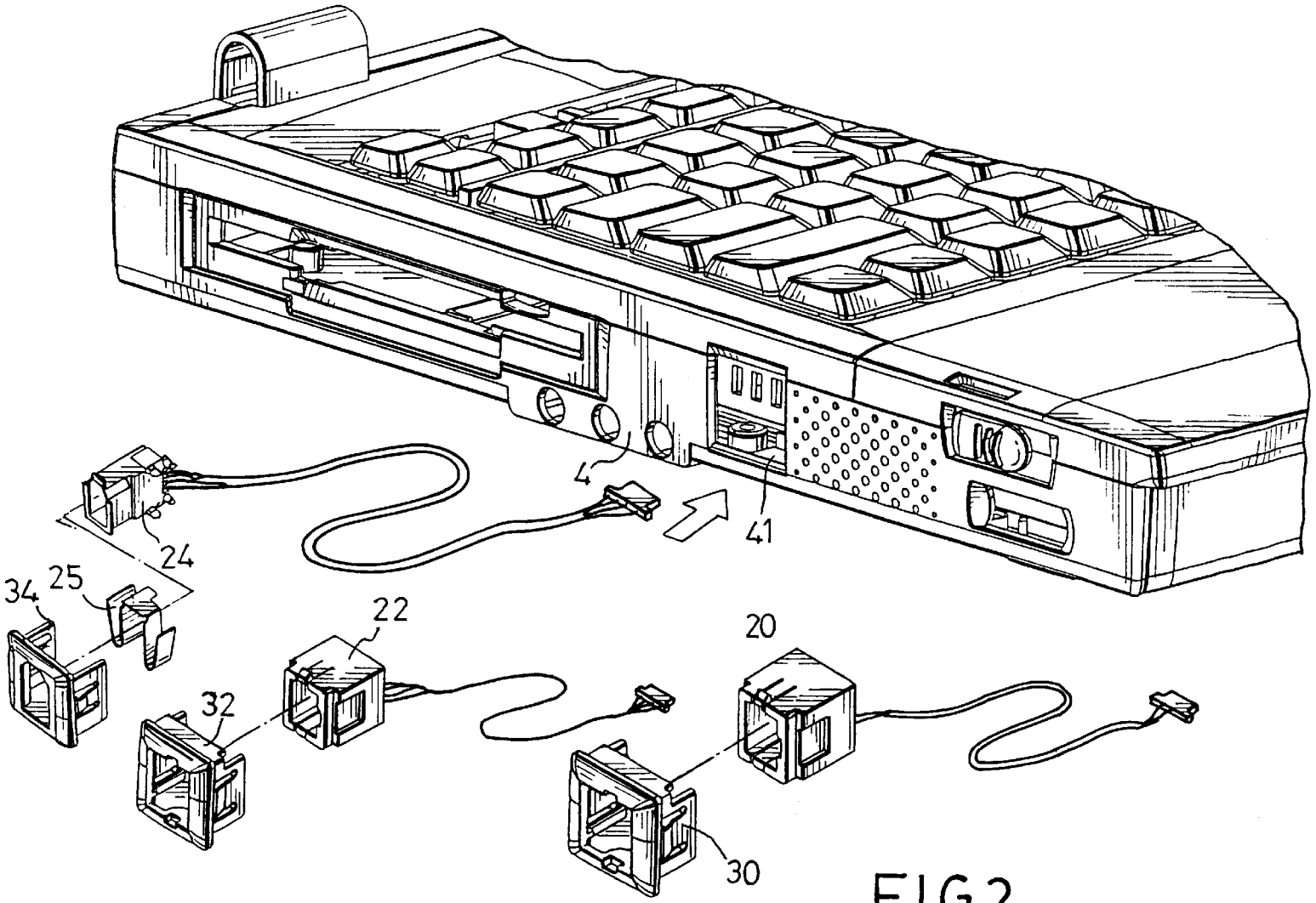
FIG. 2 is a fragmentary exploded perspective view illustrating a preferred embodiment of the electronic device of the present invention.

Referring to FIG. 2, the electronic device of the preferred embodiment of the present invention is embodied in a notebook computer having a computer housing 4 which is formed with a mounting hole 41 for mounting selectively with differently-sized network socket connectors. In the present embodiment, three kinds of socket connectors, including a modem connector 20, a LAN connector 22 and an IEEE 1394 connector 24, are illustrated. The mounting hole 41 is formed in a side wall of the computer housing 4, and is larger than a cross-sectional size of each of the socket connectors 20, 22, 24. Each of the connectors 20, 22, 24 can be retained at the mounting hole 41 using a corresponding mounting frame 30, 32, 34.

Figure 3:
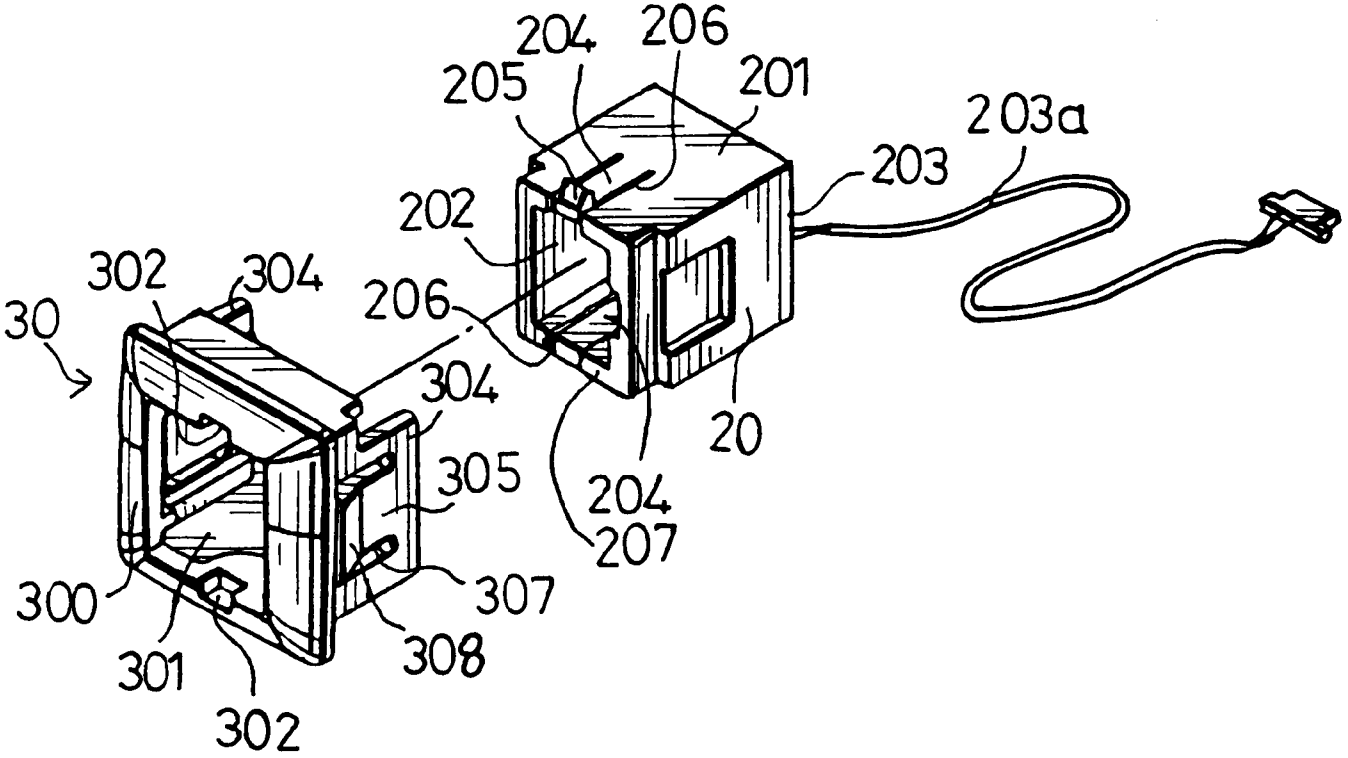
FIG. 3 is an exploded perspective view illustrating a socket connector and a corresponding first mounting frame of the electronic device of the preferred embodiment, where the socket connector is a modem connector.
Figure 4:
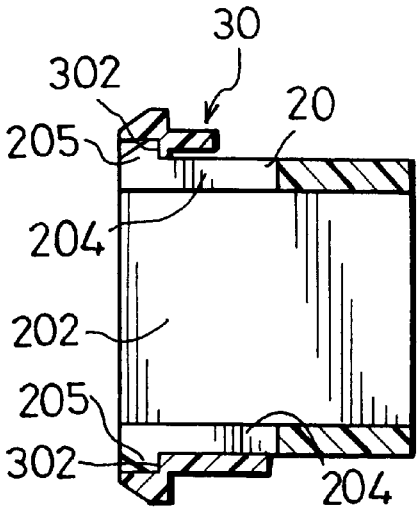
FIG. 4 is a sectional view illustrating the engagement between the modem connector and the first mounting frame.

Referring to FIGS. 3 and 4, in the case the socket connector to be mounted on the computer housing 4 is a modem connector 20, a first mounting frame 30 is provided for retaining the modem connector 20 in the mounting hole 41. As shown, the modem connector 20 has a front connector mating portion 202 adapted for mating with a complementary electrical connector (not shown) and a rear circuit connecting portion 203 adapted to be connected to an electrical cable unit 203*a* via terminals (not shown) inside the modem connector 20. The modem connector 20 has opposite first and second walls 201, 207 on upper and lower portions thereof. Each of the first and second walls 201, 207 is formed with an opening 206, and has a resilient engaging member 204 disposed in the opening 206. The engaging member 204 is formed as a tab having a first end connected integrally to the respective one of the first and second walls 201, 207 at a periphery defining the opening 206, and a distal second end formed with a hook projection 205.

The mounting frame 30 includes a rectangular looped frame part 300 which is disposed around the connector mating portion 202 of the socket connector 20 and which has an inner wall surface that confronts the connector mating portion 202 and that confines an access opening 301 for access to the socket connector 20. The inner wall surface of the looped frame part 300 of the mounting frame 30 is formed with a pair of opposing engaging grooves 302 on upper and lower surfaces of the access opening 301 for engaging resiliently and respectively the hook projections 205 on the engaging members 204 of the socket connector 20 so as to retain the socket connector 20 on the mounting frame 30.

Figure 5:
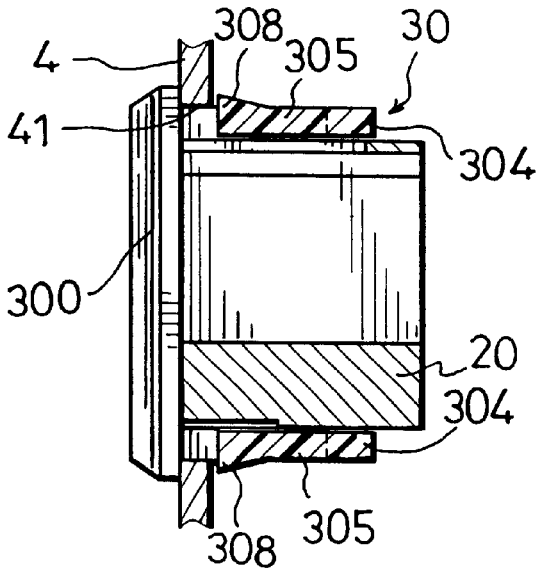
FIG. 5 is another sectional view illustrating how the mounting frame is retained at a mounting hole in a computer housing of the preferred embodiment.

Referring to FIGS. 3 and 5, the mounting frame 30 further includes a parallel pair of side plates 304 that extend rearwardly from opposite lateral portions of the looped frame part 300 through the mounting hole 41 in the computer housing 4 and that have the socket connector 20 disposed therebetween. Each of the side plates 304 is formed with an opening 307, and has a resilient retaining member 305 disposed in the opening 307. The retaining member 305 is formed as a tab having a first end connected integrally to the respective side plate 304, and a distal second end formed with an abutment projection 308 for abutting against an inner surface of the side wall of the computer housing 4 at the periphery defining the mounting hole 41. The looped frame part 300 abuts against an outer surface of the side wall of the computer housing 4, and cooperates with the retaining member 305 to clamp the side wall of the computer housing 4 at the periphery defining the mounting hole 41, thereby retaining the mounting frame 30 on the computer housing 4.

Figure 6:
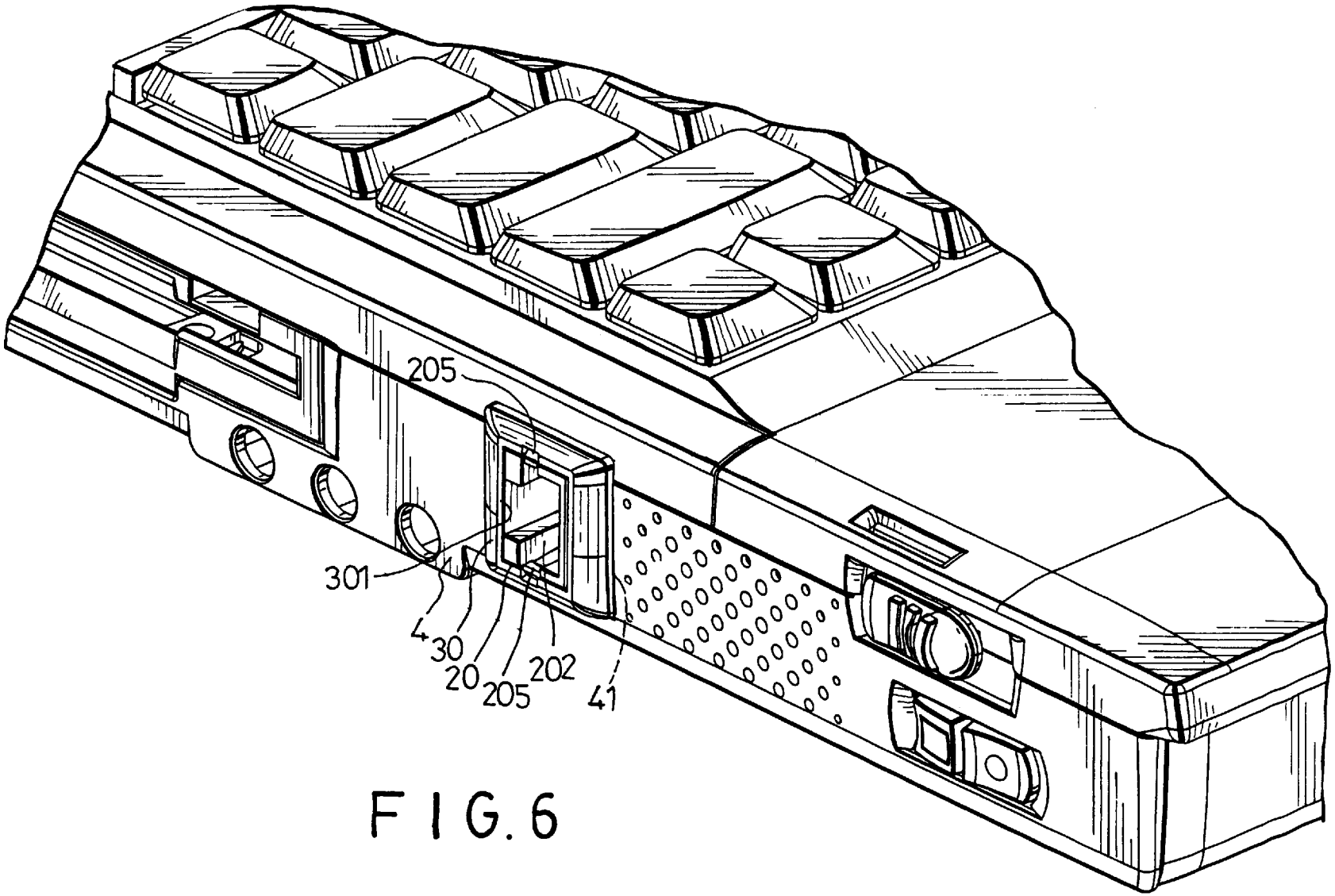
FIG. 6 is a fragmentary perspective view illustrating the electronic device of the preferred embodiment, where the computer housing is mounted with the modem connector.

Referring to FIGS. 3 and 6, to mount the socket connector 20 on the computer housing 4, the socket connector 20 is disposed in the mounting frame 30 and is retained on the latter via the engagement between the hook projections 205 and the engaging grooves 302. The electrical cable unit 203*a* is then extended into the computer housing 4 for connection with a circuit board of the computer. Thereafter, the mounting frame 30 is extended through the mounting hole 41, allowing the abutment projections 308 on the resilient retaining members 305 to abut against the inner surface of the side wall of the computer housing 4 at the periphery defining the mounting hole 41, thereby retaining the mounting frame 30 on the computer housing 4.

Figure 7:
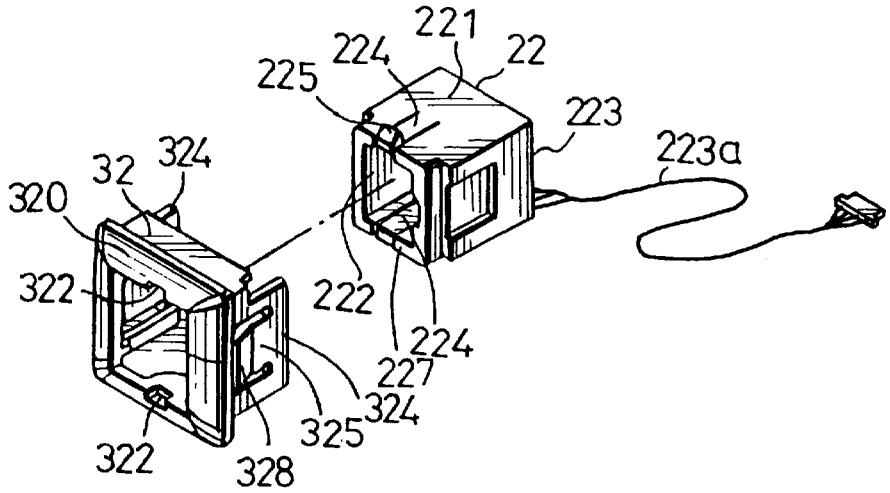
FIG. 7 is an exploded perspective view illustrating another socket connector and a corresponding second mounting frame of the electronic device of the preferred embodiment, where the socket connector is a LAN connector.
Figure 8:
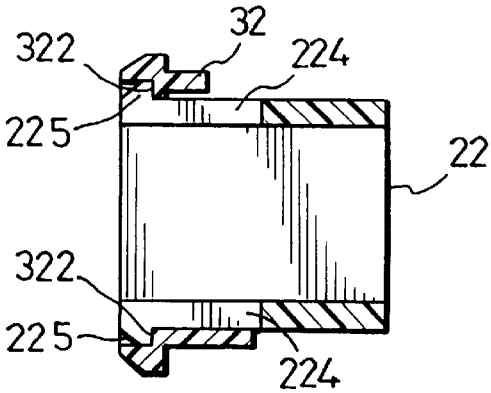
FIG. 8 is a sectional view illustrating the engagement between the LAN connector and the second mounting frame.
Figure 9:
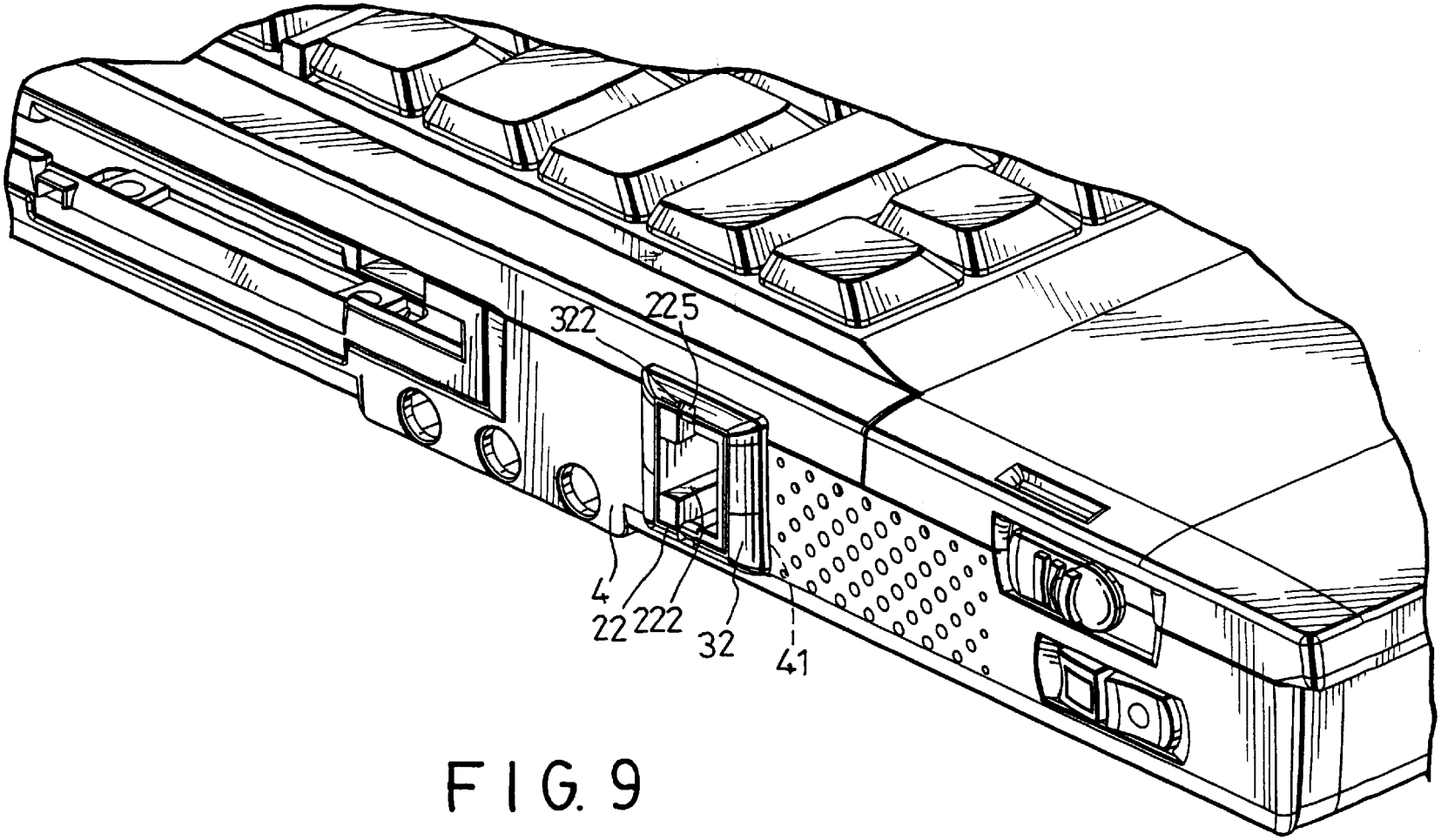
FIG. 9 is a fragmentary perspective view illustrating the electronic device of the preferred embodiment, where the computer housing is mounted with the LAN connector.

Referring to FIGS. 7 to 9, in the case the socket connector to be mounted on the computer housing 4 is a local area network (LAN) connector 22, a second mounting frame 32 is provided for retaining the LAN connector 22 in the mounting hole 41. As shown, the LAN connector 22 has a shape similar to that of the modem connector 20 but differs from the latter in size. The LAN connector 22 includes a front connector mating portion 222 and a rear circuit connecting portion 223 connected to an electrical cable unit 223*a*. The LAN connector 22 has opposite first and second walls 221, 227 which are formed integrally with resilient engaging members 224 that have distal ends formed with hook projections 225. The second mounting frame 32 has a structure similar to that of the first mounting frame 30, but has a size different from that of the latter. The second mounting frame 32 includes a rectangular looped frame part 320 which has an inner wall surface formed with a pair of opposing engaging grooves 322 for engaging resiliently and respectively the hook projections 225 on the engaging members 224 of the socket connector 22 so as to retain the socket connector 22 on the mounting frame 32.

The mounting frame 32 also includes a parallel pair of side plates 324 that have the socket connector 22 disposed therebetween and that are each formed integrally with a respective resilient retaining member 325 which has a distal end formed with an abutment projection 328 for abutting against an inner surface of the side wall of the computer housing 4 at the periphery defining the mounting hole 41 when the second mounting frame 32 is extended through the mounting hole 41. The looped frame part 320 abuts against an outer surface of the side wall of the computer housing 4, and cooperates with the retaining members 325 to clamp the side wall of the computer housing 4 at the periphery defining the mounting hole 41, thereby retaining the second mounting frame 32 on the computer housing 4.

Figure 10:
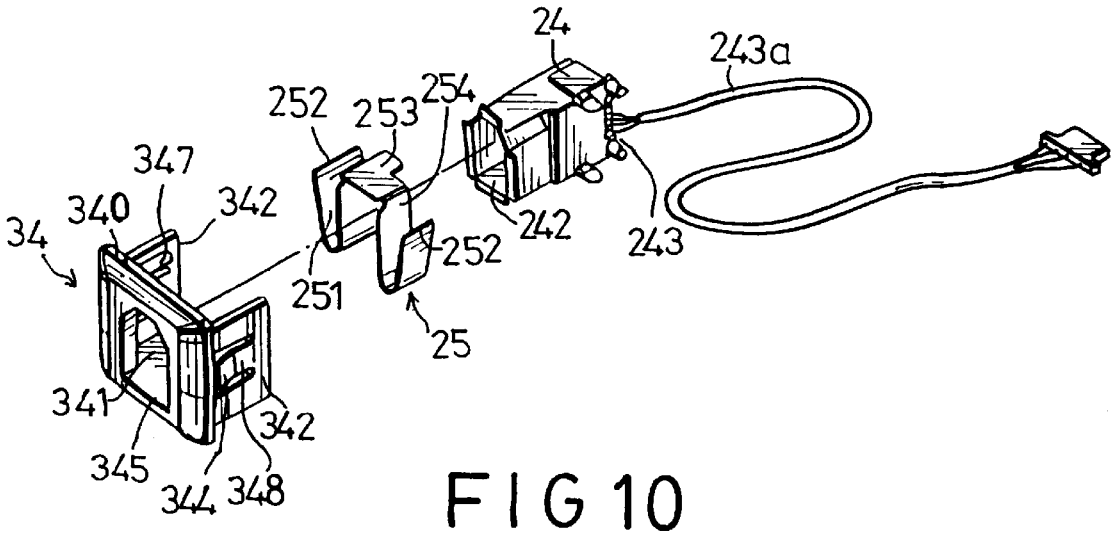
FIG. 10 is an exploded perspective view illustrating still another socket connector, a corresponding third mounting frame, and a clamping member of the electronic device of the preferred embodiment, where the socket connector is an IEEE 1394 connector.
Figure 11:
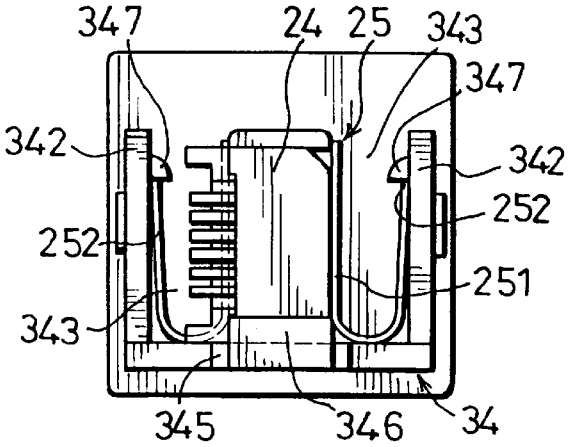
FIG. 11 is a schematic view illustrating the engagement between the IEEE 1394 connector and the third mounting frame.

Referring to FIGS. 10 and 11, in the case the socket connector to be mounted on the computer housing 4 is an IEEE 1394 connector 24, a third mounting frame 34 and a resilient clamping member 25 are provided for retaining the socket connector 24 in the mounting hole 41.

As shown, the socket connector 24 also has a front connector mating portion 242 with a generally pentagonal cross-section and adapted for mating with a complementary electrical connector (not shown) and a rear circuit connecting portion 243 adapted to be connected to an electrical cable unit 243. The third mounting frame 34 includes a rectangular looped frame part 340 which is disposed adjacent to the connector mating portion 242 of the socket connector 24 and which has an inner wall surface that confronts the connector mating portion 242 and that confines an access opening 341 having a shape conforming with that of the connector mating portion 242 of the socket connector 24 for access to the socket connector 24. The mounting frame 34 further includes a parallel pair of side plates 342 that extend rearwardly from opposite lateral portions of the looped frame part 340 and that have the socket connector 24 disposed therebetween. The side plates 342 form clearances 343 with opposite lateral sides of the socket connector 24. As with the first and second mounting frames 30, 32, each of the side plates 342 is formed integrally with a resilient retaining member 348 which has a distal end formed with an abutment projection 344 for abutting against an inner surface of the side wall of the computer housing 4 at the periphery defining the mounting hole 41 when the mounting frame 34 is extended through the mounting hole 41. The looped frame part 340 abuts against an outer surface of the side wall of the computer housing 4, and cooperates with the retaining members 348 to clamp the side wall of the computer housing 4 at the periphery defining the mounting hole 41, thereby retaining the mounting frame 34 on the computer housing 4. Each of the side plates 342 has an inner surface facing the socket connector 24 and formed with a stop projection 347 adjacent to an upper edge thereof. The mounting frame 34 further has a bottom plate 345 which extends rearwardly from the looped frame part 340 and which is disposed between the side plates 342. The bottom plate 345 has the socket connector 24 disposed thereon, and is formed with a hook projection 346 for engaging a distal bottom edge of the circuit connecting portion 243 of the socket connector 24, thereby preventing rearward movement of the socket connector 24 away from the looped frame part 340.

The clamping member 25 is disposed between the side plates 342 of the mounting frame 34, and includes a pair of resilient clamping arms 251 which extend respectively into the clearances 343, and a connecting plate 253 interconnecting the clamping arms 251 and disposed on a top side of the socket connector 24. Each of the clamping arms 251 is generally U-shaped, and has an outer section abutting against a respective one of the side plates 342, and an inner section abutting against a respective one of the lateral sides of the socket connector 24 for retaining resiliently the socket connector 24 onto the side plates 342. Each of the clamping arms 251 has an outer distal end 252 abutting against the stop projection 347 on the respective one of the side plates 342 of the mounting frame 34, and an inner connecting end 254 opposite to the distal end 252. The connecting plate 253 has opposite edges connected to the connecting ends 254 of the clamping arms 251.

Figure 12:
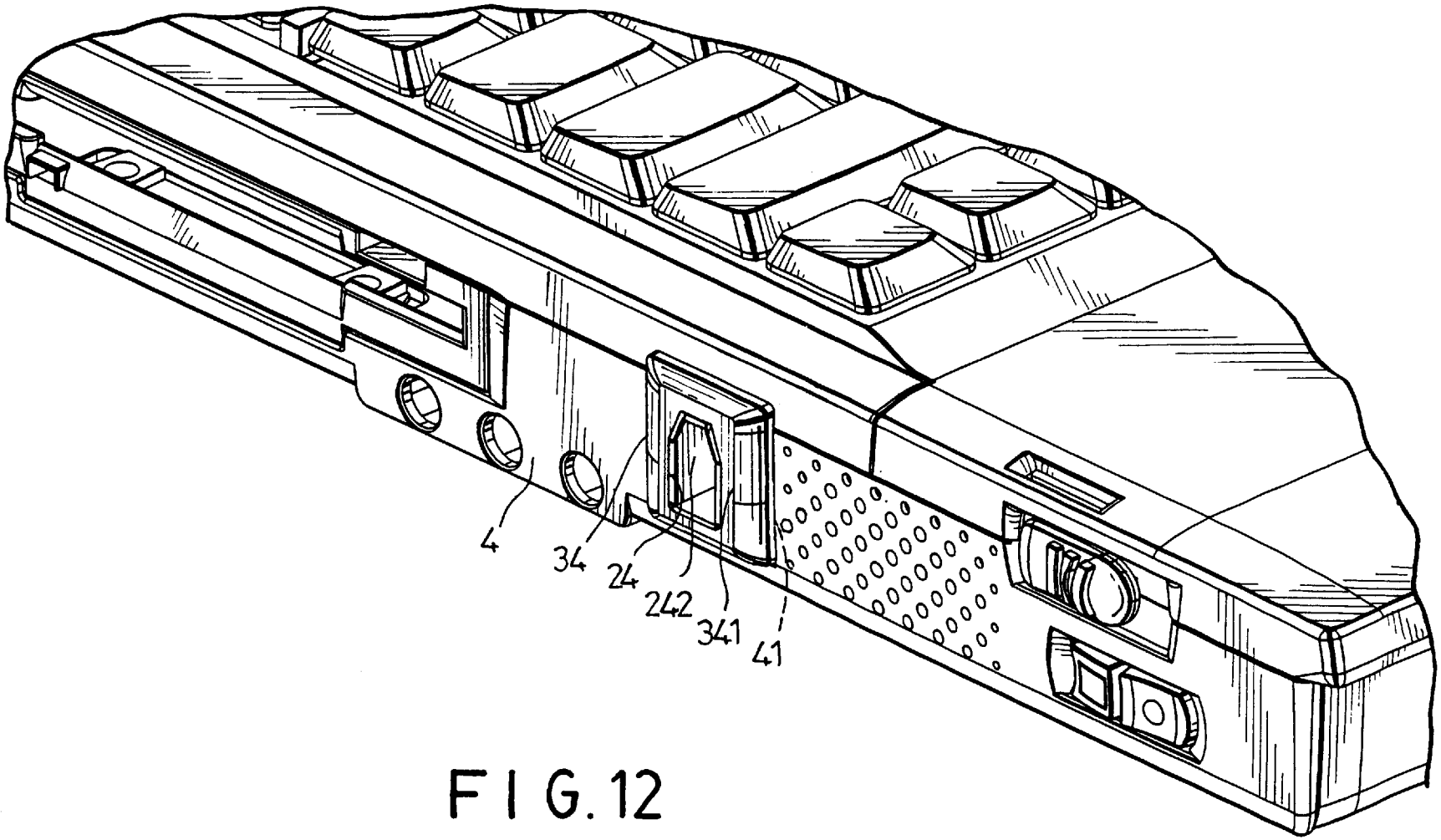
FIG. 12 is a fragmentary perspective view illustrating the electronic device of the preferred embodiment, where the computer housing is mounted with the IEEE 1394 connector.

Referring to FIGS. 10 to 12, in assembly, the connecting plate 253 of the clamping member 25 is disposed on the top side of the socket connector 24 such that the socket connector 24 is clamped between the clamping arms 251. Then, the clamping member 25 and the socket connector 24 are extended between the side plates 342 of the mounting frame 34 such that the distal bottom edge of the circuit connecting portion 243 of the socket connector 24 engages the hook projection 346 on the bottom plate 345 and such that the clamping arms 251 abut against the side plates 342, respectively, with the distal ends 252 thereof abutting against the stop projections 347, respectively, for positioning and retaining the socket connector 24 on the mounting frame 34. Thereafter, the electrical cable unit 243*a* is extended into the computer housing 4 for connection with the circuit board of the computer. The mounting frame 34 is subsequently extended through the mounting hole 41, allowing the abutment projections 344 on the resilient retaining members 348 to abut against the inner surface of the side wall of the computer housing 4 at the periphery defining the mounting hole 41, thereby retaining the mounting frame 34 on the computer housing 4.

It should be noted that, although the present embodiment is illustrated in terms of the modem connector 20, the LAN connector 22, and the IEEE 1394 connector 24, the present invention is not limited to these three kinds of network socket connectors.

With the use of the present invention, the computer housing 4 is formed with only one mounting hole 41 of a predetermined size for mounting selectively with various differently-sized socket connectors 20, 22, 24.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

We claim:

1. An electronic device comprising:

a socket connector having a front connector mating portion adapted for mating with a complementary electrical connector, and a rear circuit connecting portion, said socket connector having opposite first and second walls;

a housing having a side wall formed with a mounting hole, said mounting hole being larger than a cross-sectional size of said socket connector;

a mounting frame disposed around said socket connector and extending through said mounting hole, said mounting frame including a looped frame part with an inner wall surface that confronts said connector mating portion of said socket connector;

a socket retaining unit, provided on said socket connector and said mounting frame, for retaining said socket connector on said mounting frame, said socket retaining unit including a pair of resilient engaging members formed respectively on said first and second walls of said socket connector, and a pair of opposing engaging grooves formed in said inner wall surface of said looped frame Part for engaging resiliently and respectively said engaging members on said socket connector; and a frame retaining unit, provided on said mounting frame and said housing, for retaining said mounting frame on said housing.

2. The electronic device of claim 1, wherein each of said first and second walls of said socket connector is formed with an opening having the respective one of said engaging members disposed therein, each of said engaging members being formed as a tab having a first end connected integrally to the respective one of said first and second walls of said socket connector at a periphery defining said opening, and a second end formed with a hook projection for engaging resiliently said mounting frame at the respective one of said engaging grooves.

3. The electronic device of claim 1, wherein said looped frame part is disposed around said connector mating portion of said socket connector, and a parallel pair of side plates that extend from said looped frame part through said mounting hole and that have said socket connector disposed therebetween, said frame retaining unit including a pair of resilient retaining members formed respectively on said side plates of said mounting frame for engaging said side wall of said housing at a periphery defining said mounting hole.

4. The electronic device of claim 3, wherein each of said side plates of said mounting frame is formed with an opening having the respective one of said retaining members disposed therein, each of said retaining members being formed as a tab having a first end connected integrally to the respective one of said side plates of said mounting frame at a periphery defining said opening, and a second end formed with an abutment projection for abutting against an inner surface of said side wall of said housing at the periphery defining said mounting hole.

5. The electronic device of claim 4, wherein said looped frame part abuts against an outer surface of said side wall of said housing and cooperates with said retaining members to clamp said side wall of said housing at the periphery defining said mounting hole.

6. The electronic device of claim 1, wherein said socket connector is a modem connector.

7. The electronic device of claim 1, wherein said socket connector is a local area network connector.

8. The electronic device of claim 1, wherein said socket connector is an IEEE 1394 connector.

9. An electronic device comprising:

a socket connector having a front connector mating portion adapted for mating with a complementary electrical connector, and a rear circuit connecting portion;

a housing having a side wall formed with a mounting hole, said mounting hole being larger than a cross-sectional size of said socket connector;

a mounting frame which extends through said mounting hole in said side wall of said housing and which includes a looped frame part that is disposed around said socket connector and adjacent to said connector mating portion and that is formed with an access opening for access to said sock connector, and a parallel pair of side plates that extend from said looped frame part and that form clearances with opposite sides of said socket connector;

a socket retaining unit including a clamping member disposed between said side plates of said mounting frame, said clamping member having a pair of resilient clamping arms that extend respectively into said clearances and a connecting plate that interconnects said clamping arms and that is disposed on a top side of said socket connector, each of said clamping arms being generally U-shaped and having an outer distal end abutting against a respective one of said side plates of said mounting frame, and an inner connecting end connected integrally to said connecting plate and abutting against a respective one of said opposite sides of said socket connector for retaining resiliently said socket connector onto said side plates; and a frame retaining unit, provided on said mounting frame and said housing for retaining said mounting frame on said housing.

10. The electronic device of claim 9, wherein each of said side plates of said mounting frames has an inner surface facing said socket connector and formed with a stop projection, said outer distal end of each of said clamping arms abutting against said stop projection on the respective one of said side plates.

11. The electronic device of claim 10, wherein said mounting frame further has a bottom plate extending from said looped frame part between said side plates and having said socket connector disposed thereon.

12. The electronic device of claim 11, wherein said bottom plate is formed with a hook projection for engaging a distal bottom edge of said circuit connecting portion of said socket connector.

13. The electronic device of claim 9, wherein said looped frame part is disposed around said connector mating portion of said socket connector, and said parallel pair of side plates that extend from said looped frame part through said mounting hole have said socket connector disposed therebetween, said frame retaining unit including a pair of resilient retaining members formed respectively on said side plates of said mounting frame for engaging said side wall of said housing at a periphery defining said mounting hole.

14. The electronic device of claim 13, wherein each of said side plates of said mounting frame is formed with an opening having the respective one of said retaining members disposed therein, each of said retaining members being formed as a tab having a first end connected integrally to the respective one of said side plates of said mounting frame at a periphery defining said opening, and a second end formed with an abutment projection for abutting against an inner surface of said side wall of said housing at the periphery defining said mounting hole.

15. The electronic device of claim 14, wherein said looped frame part abuts against an outer surface of said side wall of said housing and cooperates with said retaining members to clamp said side wall of said housing at the periphery defining said mounting hole.

16. The electronic device of claim 9, wherein said socket connector is a modem connector.

17. The electronic device of claim 9, wherein said socket connector is a local area network connector.

18. The electronic device of claim 9, wherein said socket connector is an IEEE 1394 connector.

* * * * *